US011920875B2

(12) United States Patent
Tong

(10) Patent No.: US 11,920,875 B2
(45) Date of Patent: Mar. 5, 2024

(54) HEAT EXCHANGE TUBE, HEAT EXCHANGER, AND MANUFACTURING METHOD FOR HEAT EXCHANGE TUBE

(71) Applicant: SANHUA (HANGZHOU) MICRO CHANNEL HEAT EXCHANGER CO., LTD., Zhejiang (CN)

(72) Inventor: Zhongyao Tong, Zhejiang (CN)

(73) Assignee: SANHUA (HANGZHOU) MICRO CHANNEL HEAT EXCHANGER CO., LTD., Zhejiang (CN)

( * ) Notice: Subject to any disclaimer, the term of this patent is extended or adjusted under 35 U.S.C. 154(b) by 0 days.

(21) Appl. No.: 17/267,761

(22) PCT Filed: Aug. 14, 2019

(86) PCT No.: PCT/CN2019/100631
§ 371 (c)(1),
(2) Date: Feb. 10, 2021

(87) PCT Pub. No.: WO2020/035006
PCT Pub. Date: Feb. 20, 2020

(65) Prior Publication Data

US 2021/0172686 A1 Jun. 10, 2021

(30) Foreign Application Priority Data

Aug. 14, 2018 (CN) ..... 201810922238.8
Feb. 20, 2019 (CN) ..... 201910126254.0

(51) Int. Cl.
*F28F 1/42* (2006.01)
*F28D 1/03* (2006.01)
(Continued)

(52) U.S. Cl.
CPC ..... *F28F 1/424* (2013.01); *F28D 1/0391* (2013.01); *F28D 1/05333* (2013.01);
(Continued)

(58) Field of Classification Search
CPC ..... F28F 1/02; F28F 1/022; F28F 1/42; F28F 1/422; F28F 1/424; F28D 1/0391
See application file for complete search history.

(56) References Cited

U.S. PATENT DOCUMENTS 1,103,011 A * 7/1914 Boischevalier ..... F28F 1/128 165/DIG. 385
2,373,218 A * 4/1945 Arnold ..... F28F 1/40 29/890.048
(Continued)

FOREIGN PATENT DOCUMENTS

CN 101061362 A 10/2007
CN 101450355 A 6/2009
(Continued)

OTHER PUBLICATIONS

Examiner, "First Office Action for CN Application No. 201910126254.0", dated Sep. 3, 2021, CNIPA, China.

*Primary Examiner* — Eric S Ruppert
(74) *Attorney, Agent, or Firm* — Bridgeway IP Law Group, PLLC; Jihun Kim

(57) ABSTRACT

A heat exchange tube, a heat exchanger, and a manufacturing method for the heat exchange tube are provided. The heat exchange tube includes a tube wall and an outer fin, the tube wall is folded into a tube body, the tube body is provided with an inner fin therein, and the inner fin divides an inner chamber of the tube body into a plurality of flow channels. The outer fin is arranged outside the tube body. The outer fin is folded from a same plate with at least one of the tube wall and the inner fin.

5 Claims, 12 Drawing Sheets

(51) Int. Cl.
*F28D 1/053* (2006.01)
*F28F 1/12* (2006.01)

(52) U.S. Cl.
CPC ..... *F28F 1/128* (2013.01); *F28F 1/422* (2013.01); *F28F 2001/428* (2013.01); *F28F 2215/08* (2013.01)

(56) References Cited

U.S. PATENT DOCUMENTS

| | | | | |
|---|---|---|---|---|
| 3,845,814 | A | 11/1974 | Kun | |
| 2007/0199686 | A1* | 8/2007 | Okinotani | F28D 1/05383 165/152 |
| 2013/0206376 | A1* | 8/2013 | Shikazono | F28D 1/0316 165/172 |
| 2013/0213623 | A1* | 8/2013 | Perocchio | F28F 1/022 165/170 |

FOREIGN PATENT DOCUMENTS

| | | | | | |
|---|---|---|---|---|---|
| CN | 201885632 | U | | 6/2011 | |
| CN | 103025479 | A | | 4/2013 | |
| CN | 104654877 | A | | 5/2015 | |
| CN | 106440908 | A | * | 2/2017 | F28F 1/02 |
| JP | H0506429 | A | * | 3/1993 | |
| JP | 2011163700 | A | | 8/2011 | |
| JP | 2016097434 | A | | 5/2016 | |

* cited by examiner

HEAT EXCHANGE TUBE, HEAT EXCHANGER, AND MANUFACTURING METHOD FOR HEAT EXCHANGE TUBE

CROSS REFERENCE TO RELATED APPLICATIONS

The present application is a U.S. national phase entry under 35 USC § 371 of the International Patent Application No. PCT/CN2019/100631, filed on Aug. 14, 2019, which claims the benefit of and priority to Chinese Application No. 201810922238.8, filed on Aug. 14, 2018 and Chinese Application No. 201910126254.0, filed on Feb. 20, 2019, the entire disclosures of which are incorporated herein by reference.

FIELD

The present disclosure relates to a field of heat exchange technologies, and more particularly, to a heat exchange tube, and a heat exchanger having the same and a manufacturing method for the heat exchange tube.

BACKGROUND

A flat tube is a key component of a multi-channel heat exchanger. For the multi-channel heat exchanger in a related art, a fin and a flat tube are two independent components, and the fin needs to be welded to an outer side of a multi-hole flat tube. Since the heat of the flat tube is basically transferred to the fin through the welded portion, there is a heat exchange resistance between the flat tube and the fin, thereby affecting a heat exchange efficiency of the flat tube and the fin.

SUMMARY

An object of the present disclosure is to provide a heat exchange tube so as to improve a heat exchange efficiency between a fluid inside and a fluid outside a tube wall.

Another object of the present disclosure is to provide a heat exchanger having the heat exchange tube.

Yet another object of the present disclosure is to provide a manufacturing method for the heat exchange tube.

According to embodiments of the present disclosure, the heat exchange tube includes a tube wall and an outer fin, the tube wall is folded into a tube body, the tube body is provided with an inner fin therein, and the inner fin divides an inner chamber of the tube body into a plurality of flow channels. The outer fin is arranged outside the tube body. The outer fin is folded from a same plate with at least one of the tube wall and the inner fin.

The heat exchanger according to another object of the present disclosure includes a header and a plurality of heat exchange tubes, two ends of the heat exchange tube are inserted into the header, and the plurality of heat exchange tubes are stacked. The heat exchange tube includes a tube wall and an outer fin, the tube wall is folded into a tube body, the tube body is provided with an inner fin therein, and the inner fin divides an inner chamber of the tube body into a plurality of flow channels. The outer fin is arranged outside the tube body. The outer fin is folded from a same plate with at least one of the tube wall and the inner fin.

In the manufacturing method for the heat exchange tube according to yet another object of the present disclosure, the heat exchange tube includes a tube wall and an outer fin, the tube wall is folded into a tube body, the tube body is provided with an inner fin therein, and the inner fin divides an inner chamber of the tube body into a plurality of flow channels. The outer fin is arranged outside the tube body. The outer fin is folded from a same plate with at least one of the tube wall and the inner fin. The manufacturing method includes: processing a first plate portion into the inner fin, a second plate portion surrounding the inner fin by at least one circle to be processed into the tube wall, and processing a third plate portion into the outer fin outside the tube wall. The third plate portion and at least one of the first plate portion and the second plate portion are adjacent parts of a same plate body.

DETAILED DESCRIPTION

Figure 1:
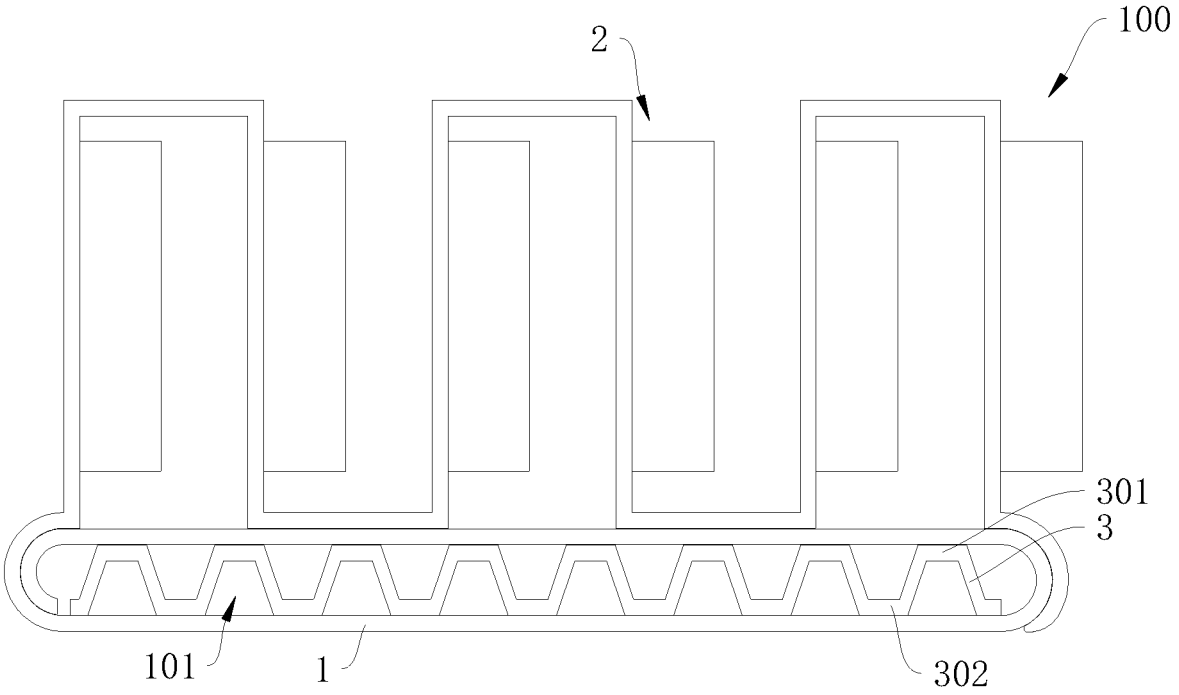
FIG. 1 is a schematic view of a heat exchange tube of an embodiment of the present disclosure.

Embodiments of the present disclosure are further described. Examples of the embodiments are illustrated in the accompanying drawings. Same or similar reference signs represent the same or similar components or components that have the same or similar functions from beginning to end. The embodiments described below with reference to the accompanying drawings are exemplary, are merely used to explain the present disclosure, and cannot be construed as a limitation to the present disclosure.

As illustrated in FIGS. 1-14, a heat exchange tube 100 according to embodiments of the present disclosure includes a tube body and an outer fin 2.

Specifically, the tube body is enclosed by a tube wall 1 and provided with an inner fin 3 therein, and the inner fin 3 divides an inner chamber of the tube body into a plurality of flow channels 101. A fluid may flow through the flow channel 101, and the fluid inside and outside the tube body may exchange heat with each other.

The outer fin 2 is arranged to an outer side of the tube body and is folded from the same plate with at least one of the tube wall 1 and the inner fin 3. That is, the outer fin 2 and the tube wall 1 are folded from the same plate, or the outer fin 2 and the inner fin 3 are folded from the same plate, or the outer fin 2, the tube wall 1 and the inner fin 3 are folded from the same plate.

In the heat exchange tube 100 according to the embodiments of the present disclosure, since the outer fin 2 is folded from the same plate with at least one of the tube wall 1 and the inner fin 3, the heat of the fluid inside the tube wall 1 may be quickly transferred to the outer fin 2, thereby realizing a rapid heat exchange between the fluid inside and outside the tube wall 1, and effectively improving a heat exchange efficiency of the fluid inside and outside the tube wall 1.

In the present disclosure, the flow channel 101 may be formed in the tube wall 1 in various manners. For example, one cavity is enclosed by the tube wall 1, the inner fin 3 includes a plurality of ribs spaced apart in the tube wall 1, and the cavity in the tube body is separated into a plurality of flow channels 101 through the plurality of ribs. For another example, one cavity is enclosed by the tube wall 1, the inner fin 3 extends in a wavy shape in the tube wall 1, and a plurality of flow channels 101 are separated in the tube wall 1 by the inner fin 3. For Yet another example, a plurality of inner chambers are enclosed by the tube wall 1, and each (or at least a part) of the plurality of inner chambers is/are provided with the inner fin 3 therein, and the flow channels 101 are separated in the corresponding inner chamber by the inner fin 3. Of course, the above description just directs to some specific manners of forming the plurality of flow channels 101 in the present disclosure, the present disclosure cannot exhaustively describe all the manners of forming the flow channels 101, and the heat exchange tube 100 obtained on a basis of the above technical features should be fallen within the scope of the present disclosure. For example, the inner fin 3 may also be directly extruded to form the plurality of flow channels 101, and then the inner fin 3 may be arranged into the tube wall 1.

In the above description of the present disclosure, "folded from the same plate" includes but is not limited to forming processes such as bending, extrusion, punching, flanging or the like. Taking the outer fin 2 and the inner fin 3 being folded from the same plate as an example, a part of the plate is made into the inner fin 3, and another part of the plate is made into the outer fin 2. The outer fin 2 is extended out of the tube wall. Moreover, the tube wall 1 is mounted and fitted with the inner fin 3 and the outer fin 2 by means of covering and clamping, and then the tube wall 1, the inner fin 3 and the outer fin 2 are fixed by welding. In following embodiments of the present disclosure, a lot of descriptions are made in regards to the folding and forming manners of the same plate, which cannot be construed as a limitation to the present disclosure.

In the present disclosure, each of the tube body, the inner fin 3 and the outer fin 2 may be formed in a plurality of manners. The respective structures and forming manners of the tube wall 1, the inner fin 3 and the outer fin 2 will be described below, respectively.

First, the tube wall 1 may have following structures.

1. The tube wall 1 has a ring structure formed by bending one end of a plate to the other end thereof.
2. The tube wall 1 has a multi-ring structure formed by bending both ends of a plate to a middle thereof. Specifically, the tube wall 1 includes a bottom wall 11, two opposite side walls 12 are arranged at both ends of the bottom wall 11, ends of the two side walls 12 extend inwards to form a top wall 13, and two ends of the top wall 13 extend to the bottom wall 11 to form two middle walls 14.

Second, the inner fin 3 may have following structures.

1. The inner fin 3 has a wavy shape formed by bending a plate.
2. The inner fin 3 includes a multi-wave structure formed by bending a plate.
3. The inner fin 3 includes a multi-wave structure formed by bending a plurality of plates, respectively.
4. The inner fin 3 includes a square-wave structure formed by bending a plate.

Third, the outer fin 2 may have following structures.

1. The outer fin 2 is a wavy structure extending along a circumferential direction of the heat exchange tube 100. For example, the outer fin 2 includes a plurality of fin units 21 extending along an axial direction of the heat exchange tube 100 and spaced apart along the circumferential direction of the heat exchange tube 100, and a connecting portion 22 connected with adjacent fin units 21. The fin unit 21 and the connecting portion 22 are connected in sequence such that the connecting portion 22 serves as a wave crest or a wave trough.
2. An air channel 201 is defined in the outer fin 2 in preceding item 1, and the air channel 201 runs through the fin unit 21.
3. A through hole is defined in the fin unit 21 in preceding item 2 to form the air channel 201.
4. A flow guide portion 27 is arranged at an edge of the air channel 201 in preceding items 2 and 3.
5. The outer fin 2 includes a base plate 23 laid on an outer surface of the tube wall 1, and the base plate 23 is provided with a plurality of turnups 24 extending away from the tube wall 1.
6. The turnup 24 in preceding item 5 is a plate structure extending along the circumferential direction of the heat exchange tube 100, and the plurality of turnups 24 are arranged along the axial direction of the heat exchange tube 100.
7. The plurality of turnups 24 in preceding item 5 are arranged into a plurality of turnup groups 202 spaced apart along the axial direction of the heat exchange tube 100, and each turnup group 202 includes multiple turnups 24 spaced apart along the circumferential direction of the heat exchange tube 100.
8. The turnup 24 in preceding items 5, 6 and 7 is provided with at least one of a louver, a through hole and a protrusion, or the turnup 24 has a corrugated structure.

The respective structures and forming manners of the tube body, the inner fin 3 and the outer fin 2 are described above, which cannot be construed as a limitation to the present disclosure. The tube body, the inner fin 3 and the outer fin 2 formed in other manners should also be fallen within the scope of the present disclosure, as long as the outer fin 2 is formed from the same plate with at least one of the inner fin 3 and the tube body in the heat exchange tube 100.

Some specific embodiments for combinations of the tube body, the inner fin 3 and the outer fin 2 are listed below with reference to the accompanying drawings.

In some embodiments, as illustrated in FIG. 1, the tube wall 1 and the outer fin 2 are folded from the same plate, the tube wall 1 is a ring structure formed by bending one end of a plate to the other end thereof, and at least one end of the tube wall 1 extends outwards to form the outer fin 2.

Specifically, in FIG. 1, the tube wall 1 surrounds the inner fin 3 by at least one circle to form the tube body, the inner fin 3 is enclosed through the tube body, the inner fin 3 divides the inner chamber of the tube body into a plurality of flow channels 101, and an end of the tube wall 1 continues to extend outwards to form the outer fin 2. The outer fin 2 may be the outer fin 2 described in the preceding embodiments or may be the outer fin 2 in other forms. As illustrated in FIG. 1, the heat exchange tube 100 is a flat tube, and the outer fin 2 has a wavy structure extending along a width direction of the heat exchange tube 100. The outer fin 2 includes a plurality of fin units 21 extending along an axial direction of the heat exchange tube 100 and spaced apart along the width direction of the heat exchange tube 100, and a connecting portion 22 connected with adjacent fin units 21. The fin unit 21 and the connecting portion 22 are connected in sequence such that the connecting portion 22 serves as a wave crest or a wave trough. The fin unit 21 is provided with a rectangular through hole which serves as an air channel 201, a flow guide portion 27 is arranged at a side edge of the rectangular through hole, and the flow guide portion 27 and the rectangular through hole are formed by flanging the fin unit 21.

In some embodiments, in a process of the tube wall 1 surrounding the inner fin 3, the two ends of the tube wall 1 are lapped together to realize an effective sealing of the tube body.

In addition, the outer fin 2 may surround the tube body by one circle, or may be arranged at a side of the tube body, or may surround ¼ or ⅔ of the tube body. For example, in FIG. 1, the heat exchange tube 100 is a flat tube, and the outer fin 2 is arranged on a side of the tube body and extends from one end of the tube body to the other end of the tube body. In some embodiments, a tail end of the outer fin 2 is lapped on the other end of the tube body, so as to effectively improve the stability of connection between the outer fin 2 and the tube body.

One end and the other end of the tube wall 1 refer to two ends of a plate body which forms the tube body, while one end and the other end of the tube body refer to two ends of a cross section of the tube body after the tube wall 1 surrounds the inner fin 3 to form the tube body.

For example, a second plate portion and a third plate portion are adjacent parts of the same plate body in sequence. During manufacturing, a first plate portion may be processed into the inner fin 3, the second plate portion may surround the inner fin 3 by at least one circle to be processed into the tube wall 1, and the third plate portion may be processed into the outer fin 2 outside the tube wall 1.

Figure 2:
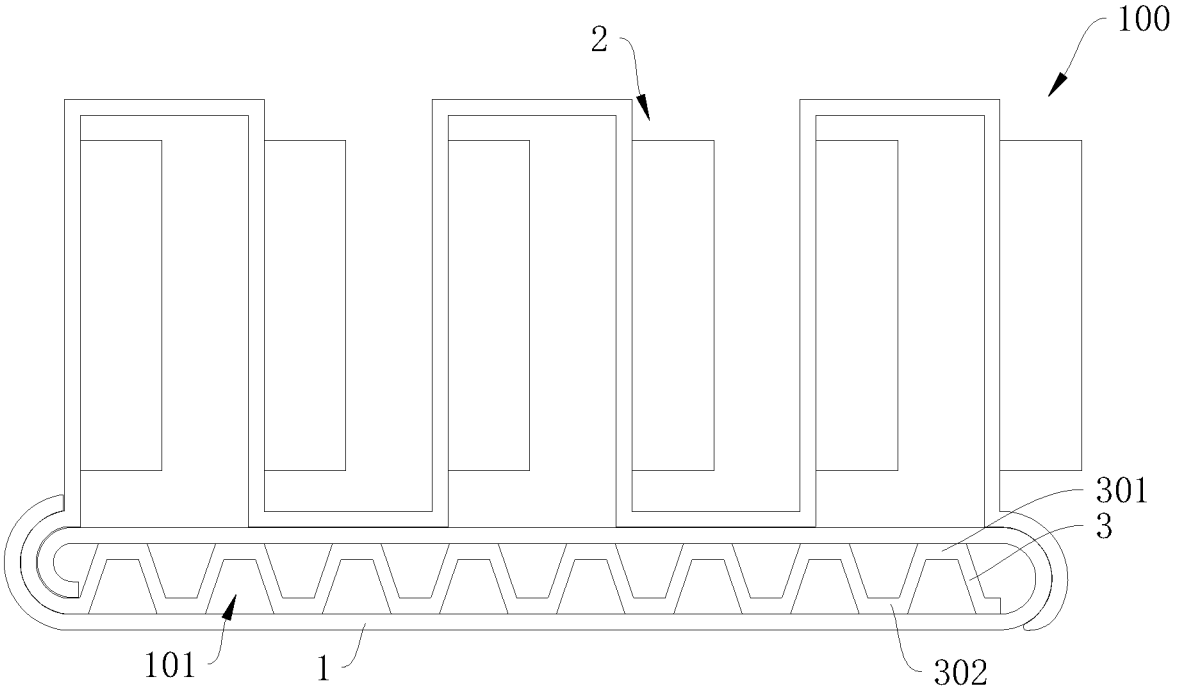
FIG. 2 is a schematic view of a heat exchange tube of an embodiment of the present disclosure.

In some embodiments, as illustrated in FIG. 2, the tube wall 1 is a ring structure formed by bending one end of a plate to the other end thereof, the inner fin 3 and the outer fin 2 are folded from the same plate, and at least one end of the inner fin 3 passes through an end of the tube wall 1 to extend outwards to form the outer fin 2.

Specifically, in FIG. 2, the tube wall 1 surrounds the inner fin 3 by at least one circle to form the tube body, the tube body encloses the inner fin 3, and the inner fin 3 divides the inner chamber of the tube body into a plurality of flow channels 101. One end of the inner fin 3 extends outwards from a joint of the two ends of the tube wall 1 to form the outer fin 2. The outer fin 2 may be the outer fin 2 described in the preceding embodiments or may be the outer fin 2 in other forms.

In some embodiments, in a process of the tube wall 1 surrounding the inner fin 3, the two ends of the tube wall 1 are lapped with parts of the inner fin 3 and the outer fin 2 at a junction thereof, so as to realize an effective sealing of the tube body.

In addition, the outer fin 2 may surround the tube body by one circle, or may be arranged on a side of the tube body, or may surround ¼ or ⅔ of the tube body. For example, in FIG. 2, the outer fin 2 is arranged on a side of the tube body and extends from one end of the tube body to the other end of the tube body. In some embodiments, a tail end of the outer fin 2 is lapped on the other end of the tube body, so as to effectively improve the stability of connection between the outer fin 2 and the tube body.

For example, a first plate portion and a third plate portion are adjacent parts of the same plate body. During manufacturing, the first plate portion may be processed into the inner fin 3, the second plate portion may surround the inner fin 3 by at least one circle to be processed into the tube wall 1, and the third plate portion may be processed into the outer fin 2 outside the tube wall 1.

In some embodiments, as illustrated in FIGS. 3-10, the tube wall 1 is a ring structure formed by bending one end of a plate to the other end thereof, and the inner fin 3, the tube body and the outer fin 2 are folded from the same plate.

Figure 3:
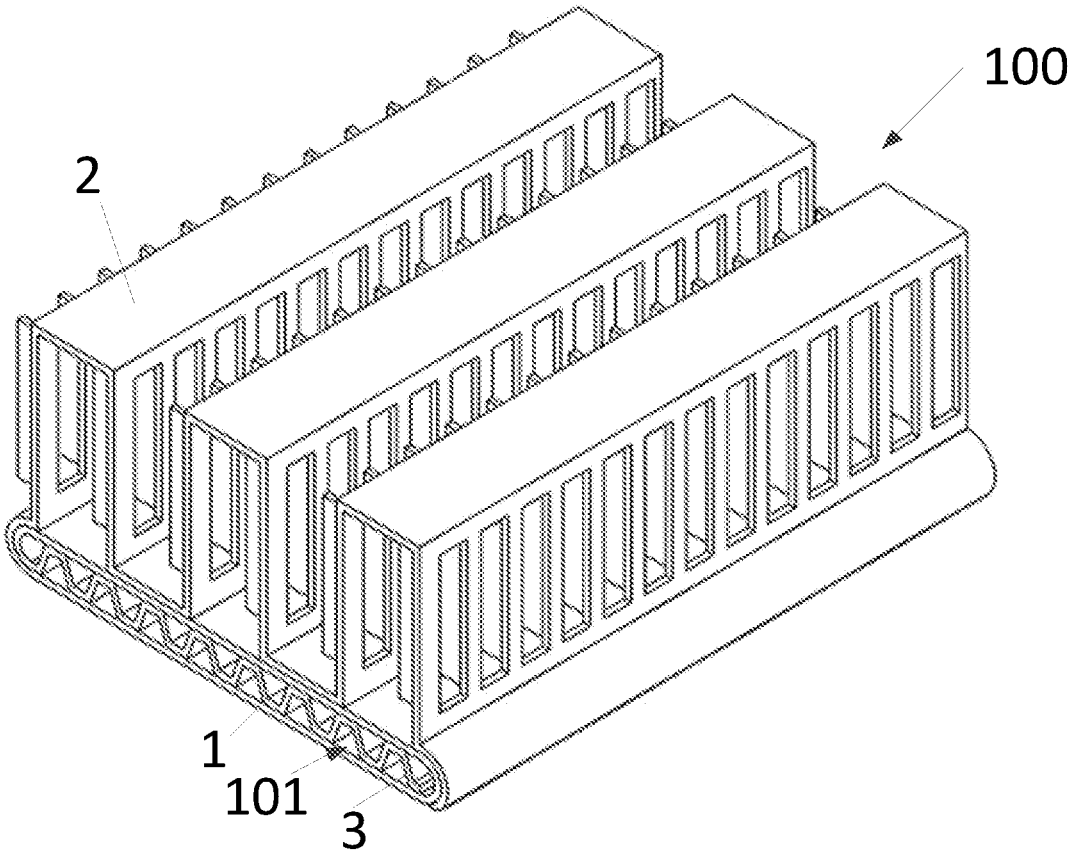
FIG. 3 is a schematic view of a heat exchange tube of an embodiment of the present disclosure.
Figure 4:
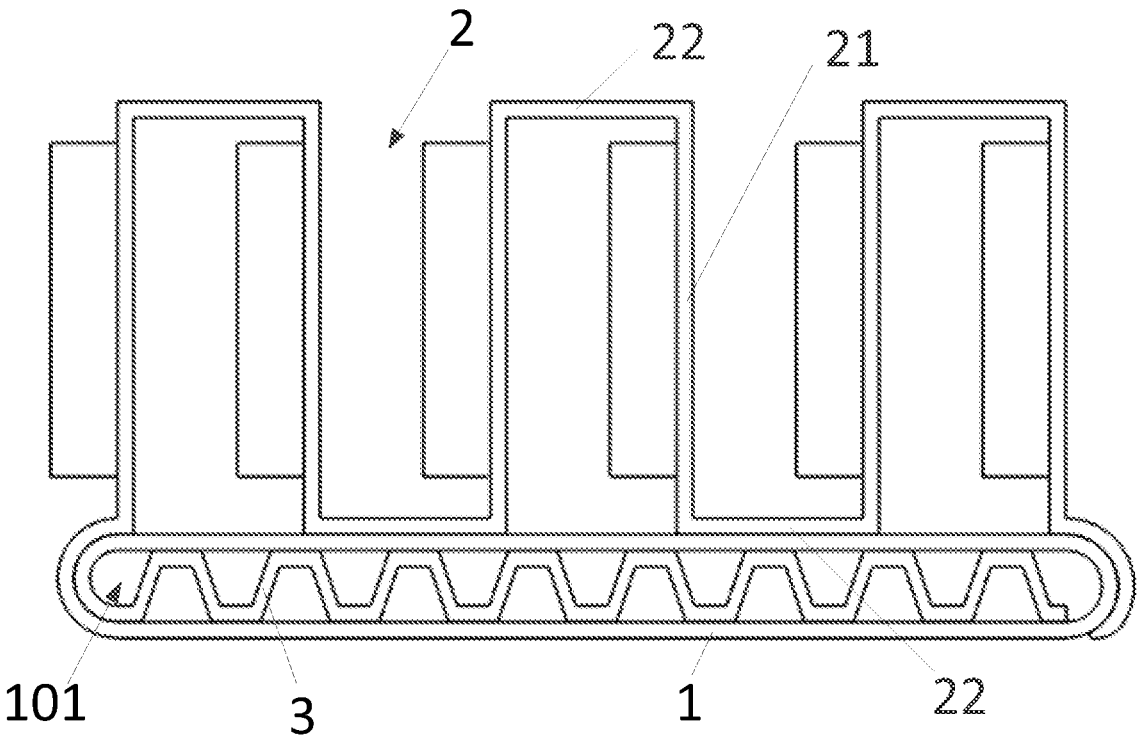
FIG. 4 is a front view of the heat exchange tube in FIG. 3.
Figure 5:
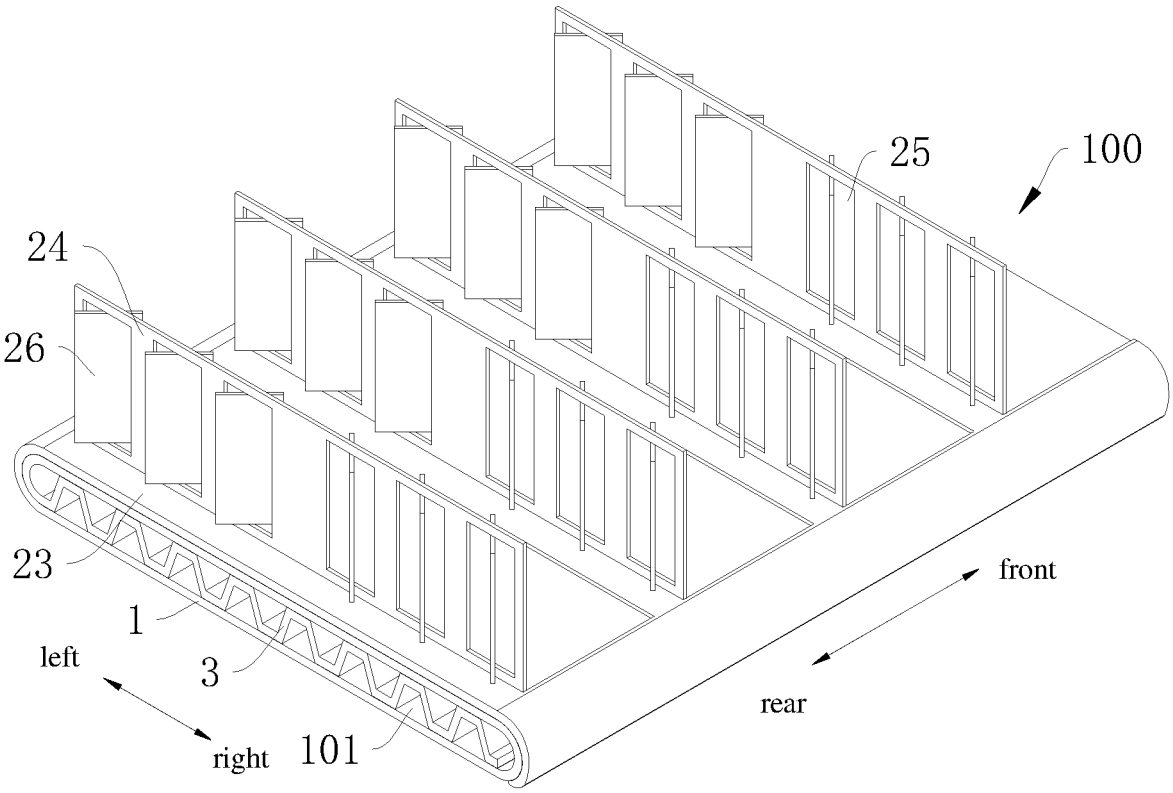
FIG. 5 is a schematic view of a heat exchange tube of an embodiment of the present disclosure.
Figure 6:
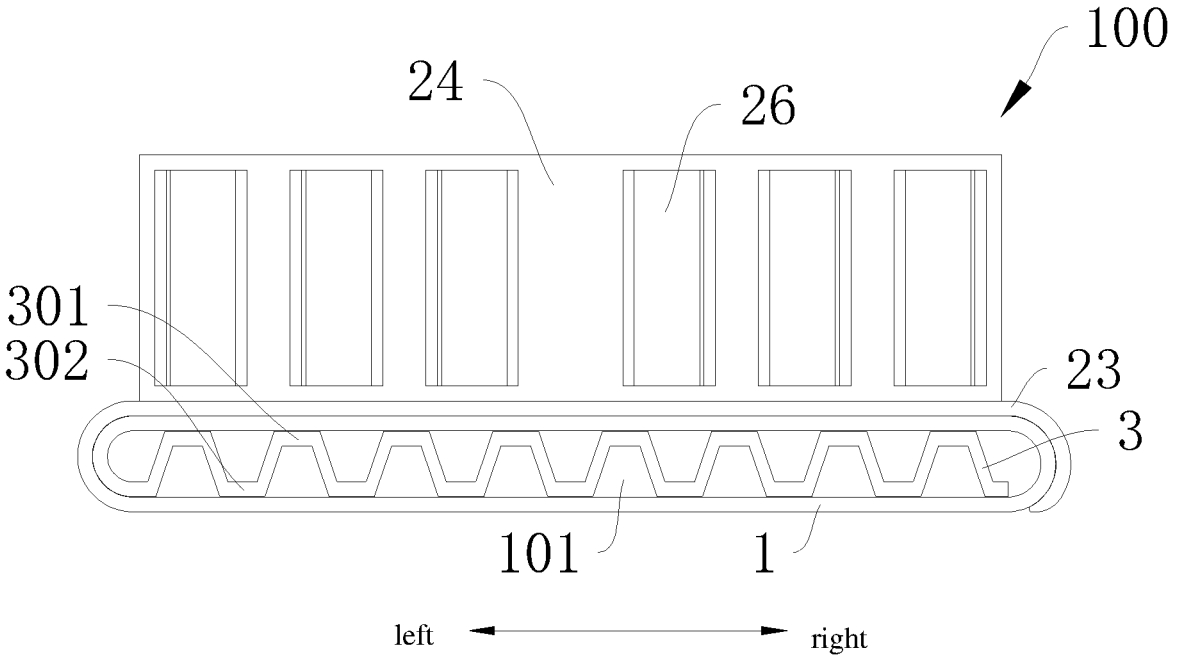
FIG. 6 is a front view of the heat exchange tube in FIG. 5.
Figure 7:
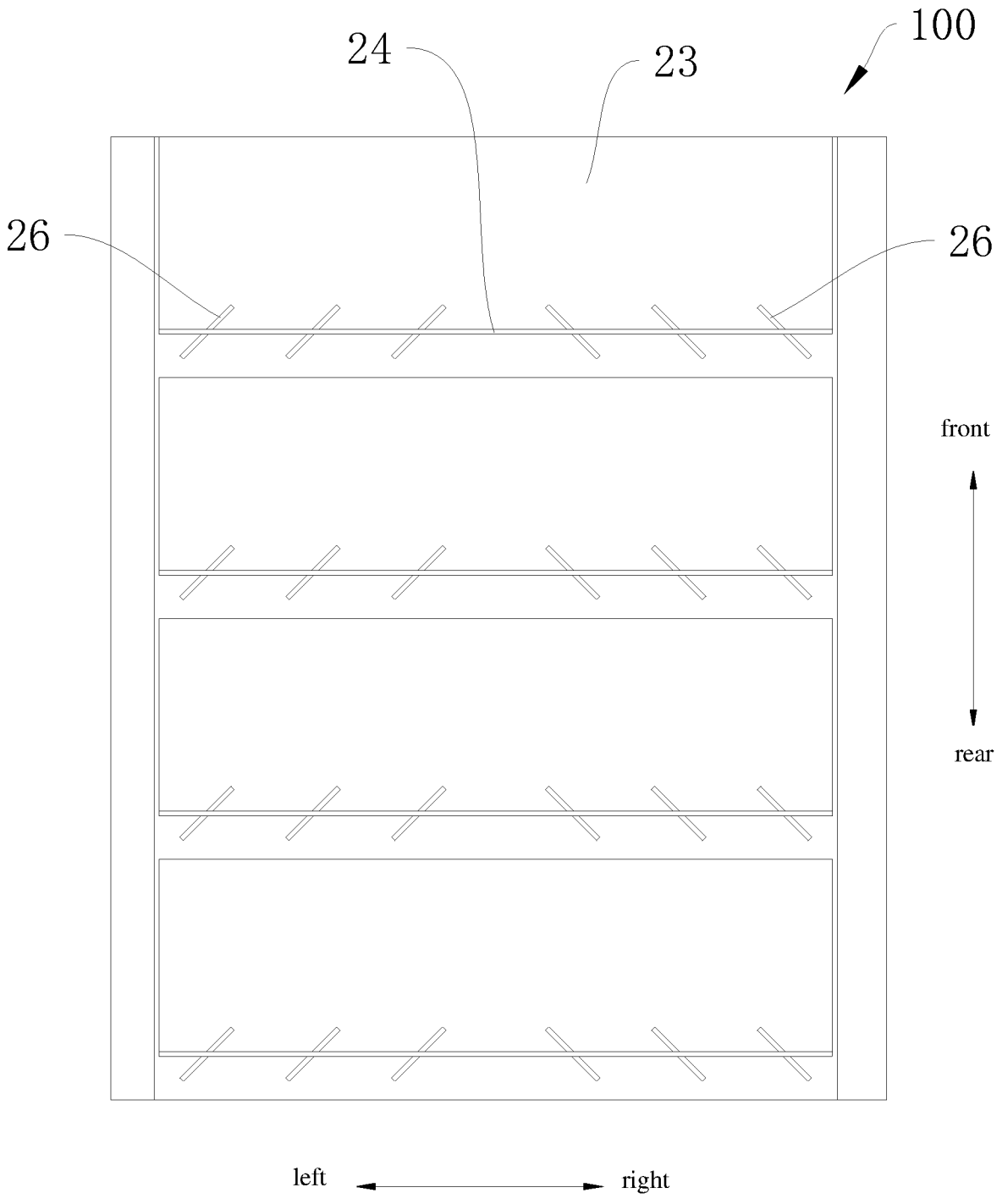
FIG. 7 is a top view of the heat exchange tube in FIG. 5.
Figure 8:
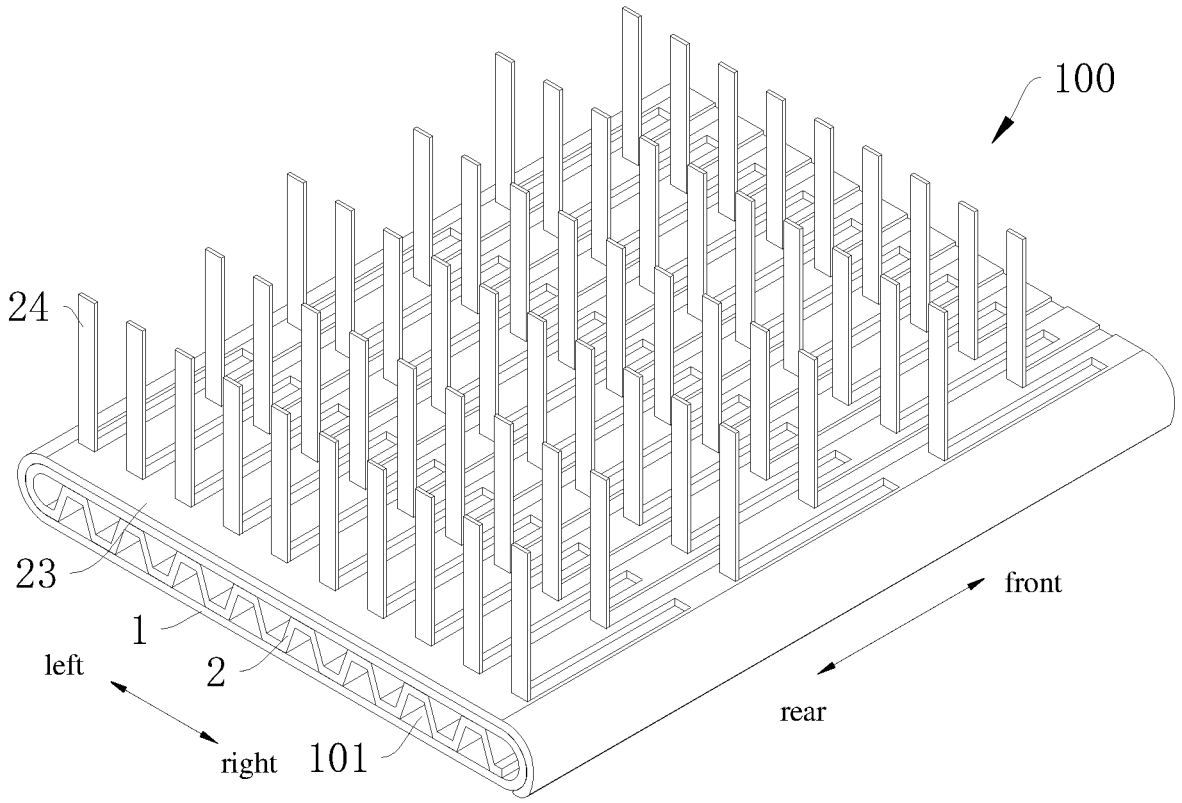
FIG. 8 is a schematic view of a heat exchange tube of an embodiment of the present disclosure.
Figure 9:
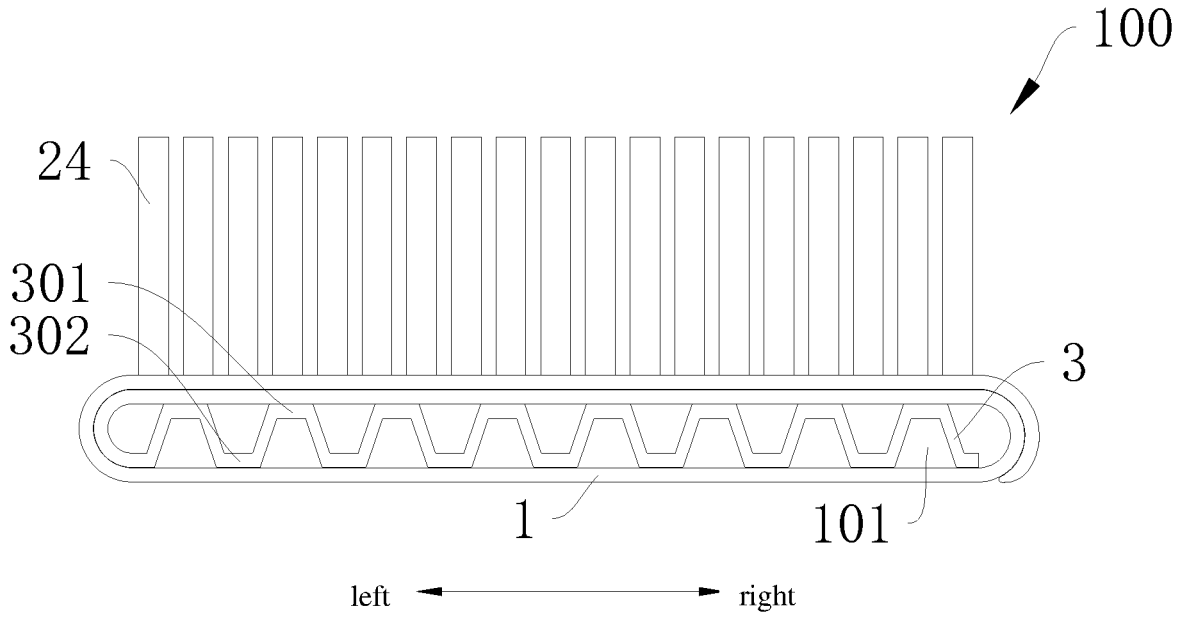
FIG. 9 is a front view of the heat exchange tube in FIG. 8.
Figure 10:
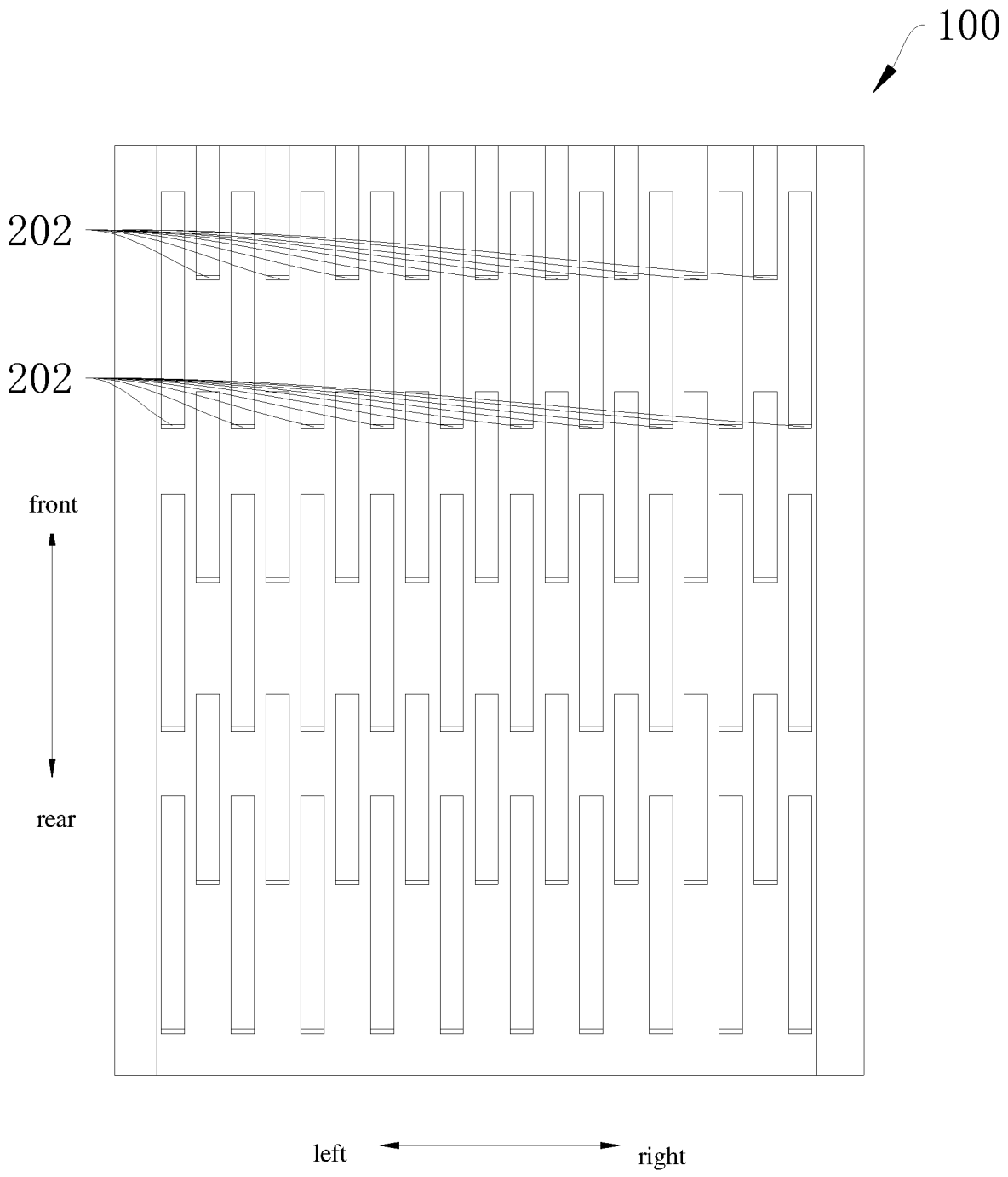
FIG. 10 is a top view of the heat exchange tube in FIG. 8.

Specifically, as illustrated in FIGS. 3-10, at least a part of a plate is divided into three adjacent parts in sequence, a first part is made into the inner fin 3, a second part surrounds the inner fin 3 by at least one circle to form the tube body, and the inner fin 3 is enclosed by the tube body. The inner fin 3 divides an inner chamber of the tube body into a plurality of flow channels 101, and an end of the tube wall 1 continues to extend outwards to form the outer fin 2. The outer fin 2 may be the outer fin 2 described in the preceding embodiments or may be the outer fin 2 in other forms. As illustrated in FIGS. 3 and 4, the structure of the outer fin 2 is the same with that in FIGS. 1 and 2, which both are wavy structures extending along the width direction of the heat exchange tube 100. As illustrated in FIGS. 5-7, the outer fin 2 includes a base plate 23 laid on an outer surface of the tube wall 1, and the base plate 23 is provided with a plurality of turnups 24 extending away from the tube wall 1. The turnup 24 extends along a width direction of the flat tube, and the plurality of turnups 24 are arranged along the axial direction of the heat exchange tube 100. The turnup 24 is provided with a louver, which includes a heat conducting plate 26 arranged at an angle with respect to the turnup and an opening 25 between the heat conducting plate 26 and the turnup 24. Besides the louver, the turnup 24 may be also provided with a through hole, a protrusion or the like, or may be processed into a corrugated structure. As illustrated in FIGS. 8-10, the outer fin 2 includes a base plate 23 laid on the outer surface of the tube wall 1, and the base plate 23 is provided with a plurality of turnup groups 202 extending away from the tube wall 1. The turnup groups 202 are arranged in a plurality of rows spaced apart along the axial direction of the heat exchange tube 100, and each turnup group 202 includes a plurality of turnups 24 spaced apart along the width direction of the heat exchange tube 100. The turnup 24 in the turnup group 202 has a needle structure due to its small width.

The above outer fins 2 of various structures may be also applicable to the heat exchange tube 100 of other folding manners, such as the heat exchange tube 100 in these embodiments and the heat exchange tube in these embodiments, and its outer fin 2 may adopt any one of the above structures.

In some embodiments, in a process of the tube wall 1 surrounding the inner fin 3, two ends of the tube wall 1 are lapped together to realize an effective sealing of the tube body.

In addition, the outer fin 2 may surround the tube body by one circle, or be arranged at a side of the tube body, or may surround ¼ or ⅔ of the tube body. For example, in FIG. 1, the outer fin 2 is arranged on a side of the tube body and extends from one end of the tube body to the other end of the tube body. In some embodiments, a tail end of the outer fin 2 is lapped on the other end of the tube body, so as to effectively improve the stability of connection between the outer fin 2 and the tube body.

For example, a first plate portion, a second plate portion and a third plate portion are adjacent parts of the same plate body in sequence. During manufacturing, the first plate portion may be processed into the inner fin 3, the second plate portion may surround the inner fin 3 by at least one circle to be processed into the tube wall 1, and the third plate portion may be processed into the outer fin 2 outside the tube wall 1.

Figure 11:
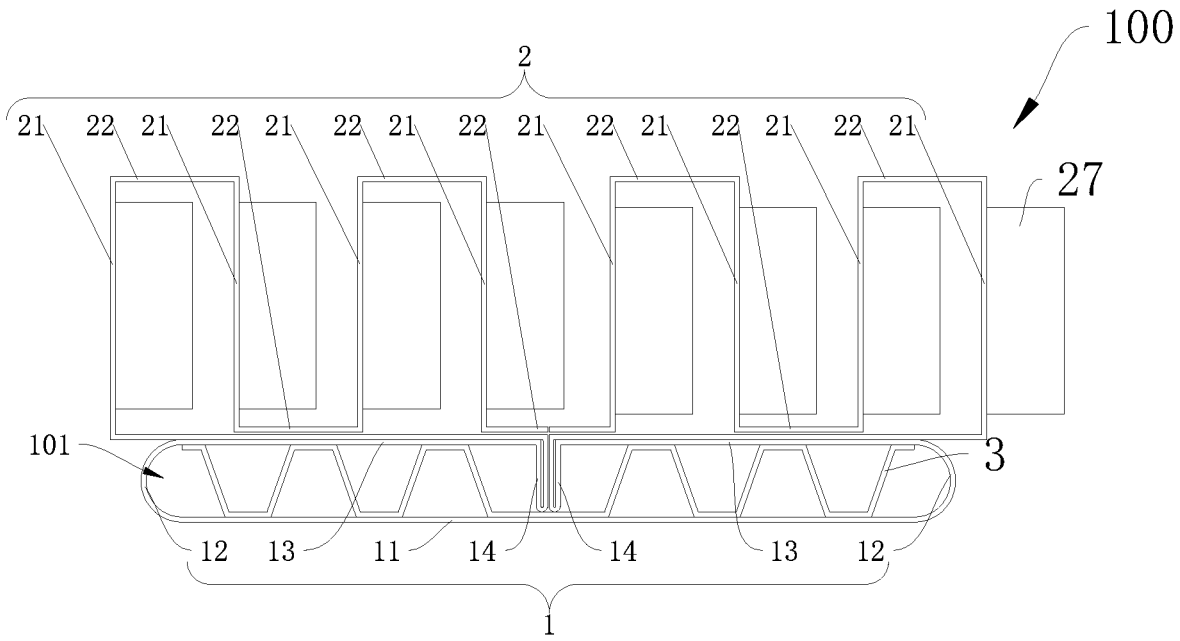
FIG. 11 is a schematic view of a heat exchange tube of an embodiment of the present disclosure.

In some embodiments, as illustrated in FIG. 11, the tube wall 1 and the outer fin 2 are folded from the same plate. The tube wall 1 includes a bottom wall 11, two opposite side walls 12 are arranged at both ends of the bottom wall 11, ends of the two side walls 12 extend inwards to form a top wall 13, and two ends of the top wall 13 extend to the bottom wall 11 to form two middle walls 14. An end of at least one of the middle walls 14 extends outwards to form the outer fin 2.

Specifically, as illustrated in FIG. 11, the inner fin 3 is made and formed, two ends of the tube wall 1 are respectively bent around different parts of the inner fin 3 to a middle thereof so as to form two inner chambers enclosing the different parts of the inner fin 3, the inner fin 3 is enclosed through the tube body, and the inner fin 3 defines a plurality of flow channels 101 in the inner chamber of the tube body. One end or two ends of the tube wall 1 continues to extend out of the tube body to form the outer fin 2. The outer fin 2 may be the outer fin 2 described in the preceding embodiments or may be the outer fin 2 in other forms. As illustrated in FIG. 11, the heat exchange tube 100 is a flat tube, and the outer fin 2 is a wavy structure extending along the width direction of the heat exchange tube 100. The outer fin 2 includes a plurality of fin units 21 extending along the axial direction of the heat exchange tube 100 and spaced apart along the width direction of the heat exchange tube 100, and a connecting portion 22 connected with adjacent fin units 21. The fin unit 21 and the connecting portion 22 are connected in sequence such that the connecting portion 22 serves as a wave crest or a wave trough. The outer fin 2 is provided with an air channel 201. The outer fin 2 is formed by the two ends of the tube wall 1 extending outwards, and includes two base plates attached to an outer side of the tube wall 1. Ends of the two base plates continue to extend to form a wavy portion, an end of the wavy portion is connected with the end of the corresponding base plate, and the wave trough 302 of the wavy portion is attached to the outer side of the tube wall 1. Of course, the outer fin 2 of this embodiment may also adopt the structure in FIGS. 5-10.

In some embodiments, in a process of the tube wall 1 surrounding the inner fin 3, the two ends of the tube wall 1 are lapped together to realize an effective sealing of the tube body.

In addition, the outer fin 2 may surround the tube body by one circle, or may be arranged at a side of the tube body, or may surround ¼ or ⅔ of the tube body. For example, in FIG. 1, the outer fin 2 is arranged on a side of the tube body.

Further, the inner fin 3 may be folded from the same plate, and different parts of the inner fin 3 are located in different chambers of the tube body. Or, separate inner fins 3 may be provided, and different inner fins 3 are located in different chambers of the tube body.

For example, a second plate portion and a third plate portion are adjacent parts of the same plate body, and the third plate portion is arranged on either side of the second plate portion. During manufacturing, the first plate portion may be processed into two inner fins 3, two sides of the second plate portion are bent to a middle thereof so as to form structures surrounding the two inner fins 3, respectively, and the third plate portion may be processed into the outer fin 2 outside the tube wall 1.

Figure 12:
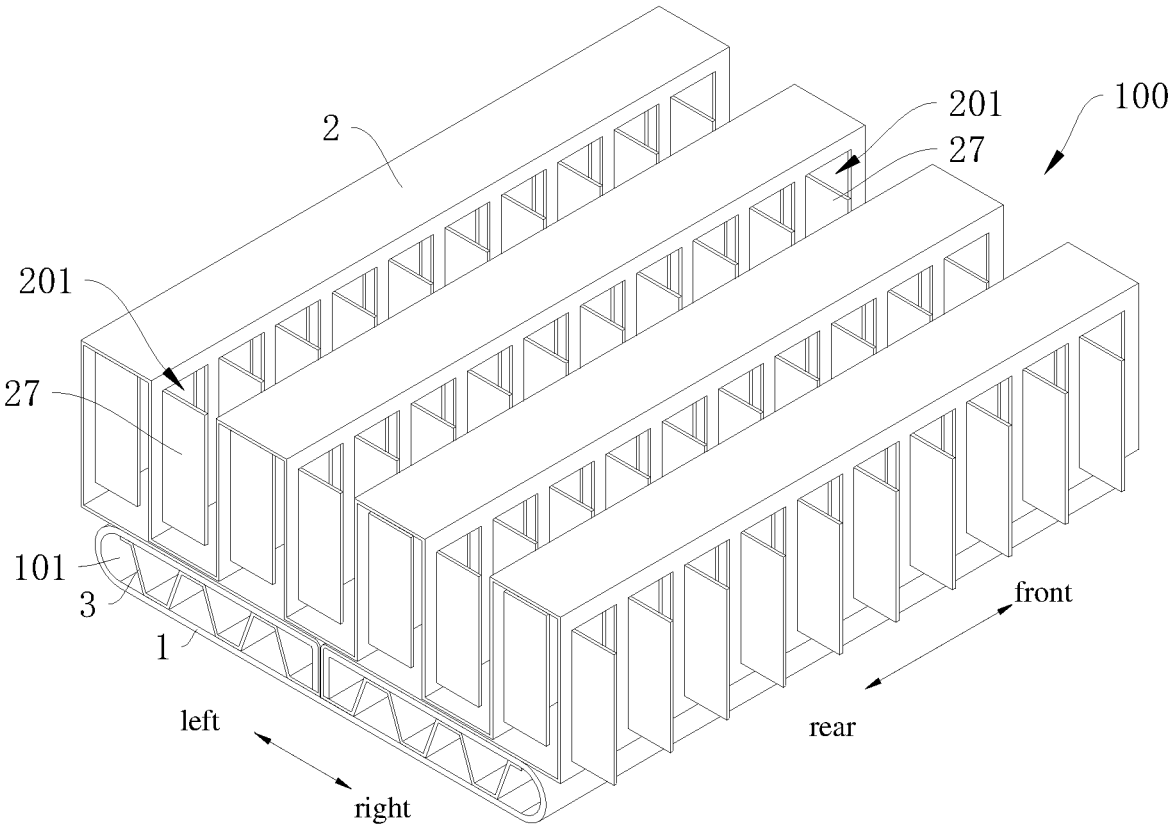
FIG. 12 is a schematic view of a heat exchange tube of an embodiment of the present disclosure.
Figure 13:
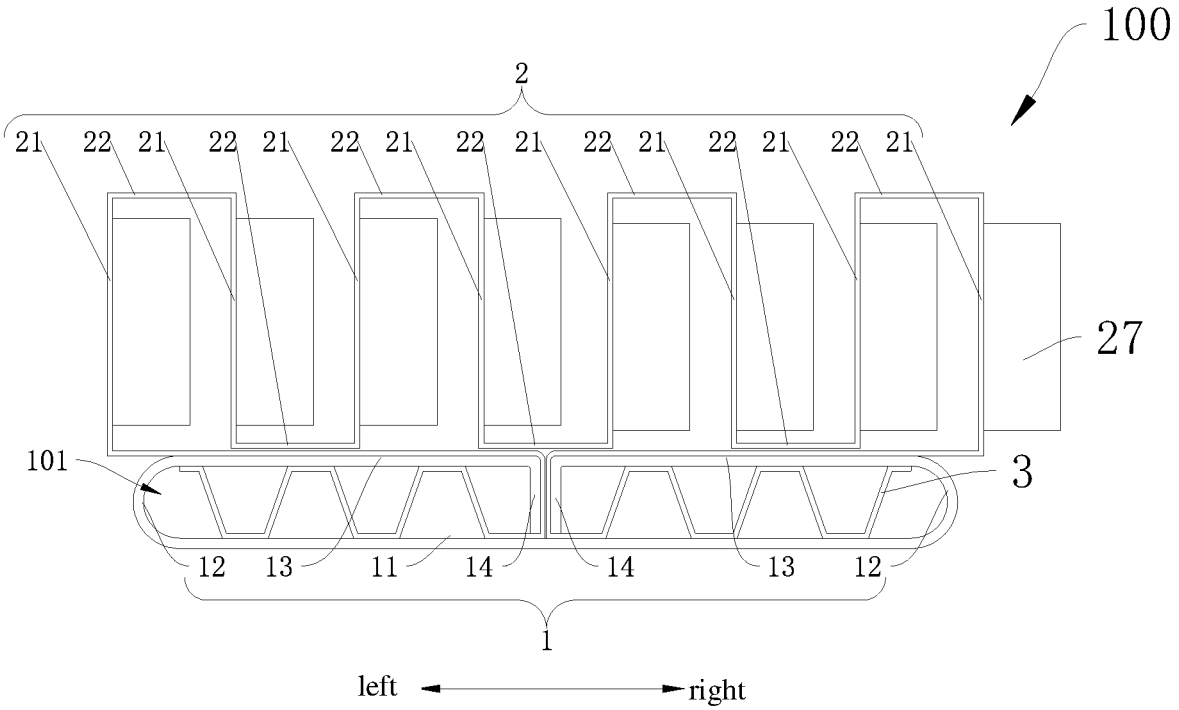
FIG. 13 is a front view of the heat exchange tube in FIG. 12.
Figure 14:
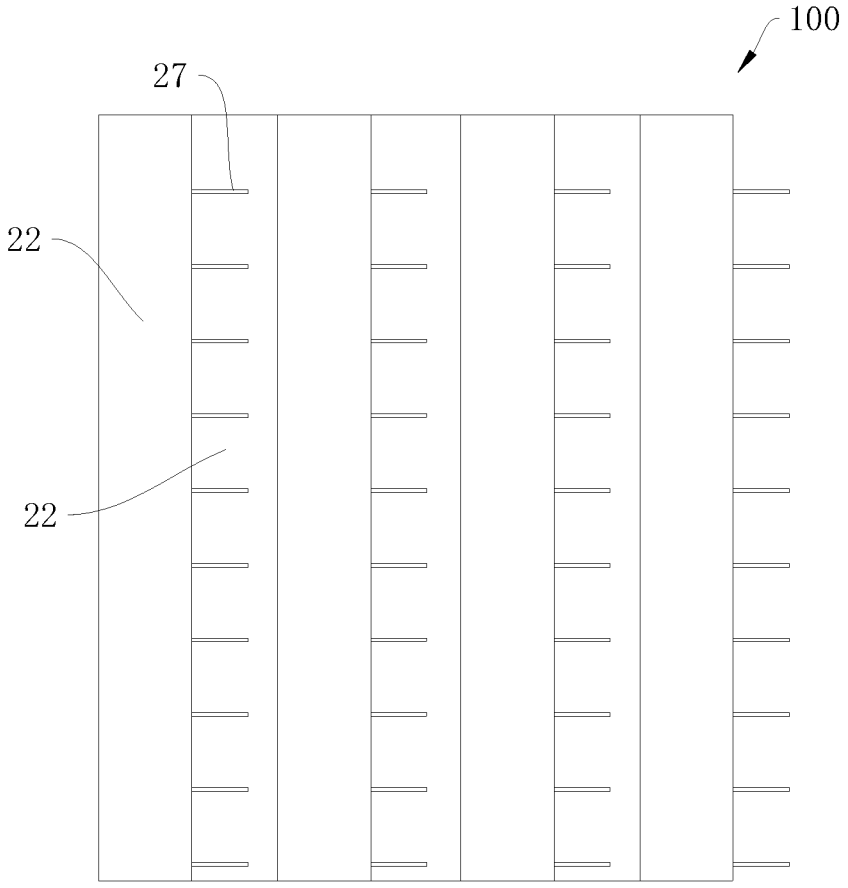
FIG. 14 is a top view of the heat exchange tube in FIG. 12.

In some embodiments, as illustrated in FIGS. 12-14, the tube wall 1 includes a bottom wall 11, two opposite side walls 12 are arranged at both ends of the bottom wall 11, ends of the two side walls 12 extend inwards to form a top wall 13, and two ends of the top wall 13 extend to the bottom wall 11 to form two middle walls 14. The inner fin 3 and the outer fin 2 are folded from the same plate, and a middle portion of the inner fin 3 passes through a gap between the two middle walls 14 and extends outwards to form the outer fin 2.

Specifically, as illustrated in FIGS. 12-14, the two inner fins 3 spaced apart and the outer fin 2 are made and formed, two ends of the tube wall 1 are respectively bent around different parts of the inner fin 3 to a middle thereof so as to form two inner chambers enclosing the different parts of the inner fin 3, the inner fin 3 is enclosed through the tube body, and the inner fin 3 defines a plurality of flow channels 101 in the inner chamber of the tube body. Parts of the two inner fins 3 therebetween extend out of the tube body to form the outer fin 2. The outer fin 2 may be the outer fin 2 described in the preceding embodiments or may be the outer fin 2 in other forms. As illustrated in FIGS. 12-14, the heat exchange tube 100 is a flat tube, and the outer fin 2 is a wavy structure extending along the width direction of the heat exchange tube 100. The outer fin 2 includes a plurality of fin units 21 extending along the axial direction of the heat exchange tube 100 and spaced apart along the width direction of the heat exchange tube 100, and a connecting portion 22 connected with adjacent fin units 21. The fin unit 21 and the connecting portion 22 are connected in sequence such that the connecting portion 22 serves as a wave crest or a wave trough. The outer fin 2 is provided with an air channel 201. The outer fin 2 is formed by the ends of the two inner fins 3 extending outwards, and includes two base plates attached to an outer side of the tube wall 1. Ends of the two base plates continue to extend to form a wavy portion, two ends of the wavy portion are connected with the ends of the corresponding base plates, and the wave trough 302 of the wavy portion is attached to the outer side of the tube wall 1. Of course, the outer fin 2 of this embodiment may also adopt the structure in FIGS. 5-10.

In some embodiments, in a process of the tube wall 1 surrounding the inner fin 3, the two ends of the tube wall 1 are lapped with parts of the inner fin 3 and outer fin 2 at a joint thereof to realize an effective sealing of the tube body.

In addition, the outer fin 2 may surround the tube body by one circle, or may be arranged at a side of the tube body, or may surround ¼ or ⅔ of the tube body. For example, in FIG. 1, the outer fin 2 is arranged on a side of the tube body.

Further, the outer fin 2 may be folded from the same plate, and different parts of the outer fin 2 enclose different inner fins 3. Or, separate outer fins 2 may be provided, and different outer fins enclose different inner fins 3.

For example, a first plate portion and a third plate portion are adjacent parts of the same plate body, and the first plate portion is arranged at either side of the third plate portion. During manufacturing, the two first plate portions may be processed into the inner fins 3, respectively, the two ends of the second plate portion are bent to the middle thereof to form structures surrounding the two inner fins 3, respectively, and the third plate portion may be processed into the outer fin 2 outside the tube wall 1.

In some embodiments, as illustrated in FIGS. 1-4 and FIGS. 11-14, the outer fin 2 is a wavy structure extending along the circumferential direction of the heat exchange tube 100. The outer fin 2 includes a plurality of fin units 21 extending along the axial direction of the heat exchange tube 100 and spaced apart along the circumferential direction of the heat exchange tube 100, and a connecting portion 22 connected with adjacent fin units 21. The fin unit 21 and the connecting portion 22 are connected in sequence, such that the connecting portion 22 serves as a wave crest or a wave trough. The outer fin 2 is also provided with an air channel 201, and the air channel 201 runs through the fin unit 21.

In other words, the outer fin 2 includes a plurality of fin units 21 and a plurality of connecting portions 22, the plurality of fin units 21 are spaced apart along the circumferential direction of the heat exchange tube 100, and each fin unit 21 extends along the axial direction of the heat exchange tube 100. Two ends of each fin unit 21 in a direction perpendicular to the axial direction and the circumferential direction of the heat exchange tube 100 are connected with the connecting portion 22, respectively, and the two connecting portions 22 connected to the same fin unit 21 extend away from each other along a direction perpendicular to the fin unit 21, such that the plurality of fin units 21 are connected through the plurality of connecting portions 22, thus forming the outer fin 2 of a wavy shape.

In some embodiments, as illustrated in FIGS. 1-4 and 11 to 14, the fin unit 21 is provided with a through hole, and the through hole is configured as an air channel 201.

In addition, a channel is also formed between two adjacent fin units 21, and an outside-tube fluid (a fluid outside the heat exchange tube 100) may flow in the air channel 201 and the channel, so as to realize the heat exchange between the fluid inside and the fluid outside the heat exchange tube 100. The fluid may be a liquid, a gas or another fluid.

In some embodiments, a flow guide portion 27 is provided at an edge of the through hole. The flow guide portion 27 may further increase a contact area between the heat exchange tube 100 and the outside-tube fluid, which may effectively improve the heat exchange efficiency.

In some embodiments, as illustrated in FIGS. 5-10, the outer fin 2 includes a base plate 23 laid on the outer surface of the tube wall 1, and the base plate 23 is provided with a plurality of turnups 24 extending away from the tube wall 1.

The turnup 24 of the base plate 23 may be bent from the base plate 23, that is, a part of the base plate 23 is bent to form the turnup 24, which may leave a hole in the base plate 23. Of course, the turnup 24 of the base plate 23 may also be formed in other manners. For example, the turnup 24 is connected or integrally formed with the base plate 23.

The base plate 23 and the tube wall 1 are stacked. The turnup 24 extends away from the tube wall 1. The base plate 23 is laid on the outer surface of the tube body so as to further effectively improve the heat exchange efficiency. Moreover, the heat exchange may be effectively performed between the turnup 24 and the base plate 23, which may improve the heat exchange efficiency of the heat exchange tube 100 to a certain extent.

A plurality of turnups 24 extending away from the tube body may be formed by a cutting process. The outer fin 2 may be formed on one surface of the tube body. When a heat exchanger is assembled, the outer fin 2 is welded with the other surface of an adjacent tube body. Of course, the outer fin 2 may be formed on both surfaces of the tube body, and an ordinary flat tube without the outer fin 2 may be welded between two heat exchange tubes 100.

In some embodiments, as illustrated in FIGS. 5-7, the turnup 24 is a plate structure extending along the circumferential direction of the heat exchange tube 100, and the plurality of turnups 24 are arranged along the axial direction of the heat exchange tube 100.

In these embodiments, the plurality of turnups 24 are arranged into a plurality of turnup groups 202 spaced apart along the axial direction of the heat exchange tube 100, and each turnup group 202 includes multiple turnups 24 spaced apart along the circumferential direction of the heat exchange tube 100. As illustrated in FIGS. 8-10, the heat exchange tube 100 is a flat tube, and the multiple turnups 24 in each turnup group 202 are spaced apart along the width direction of the flat tube. The heat exchange tube 100 may also have other shapes. For example, the heat exchange tube 100 is a flat tube with a convex side surface, and the multiple turnups 24 in each turnup group 202 are spaced apart along the circumferential direction of the heat exchange tube.

In some embodiments, as illustrated in FIGS. 5-10, the turnup 24 is provided with at least one of a louver, a through hole and a protrusion, or the turnup 24 is a corrugated structure.

The turnup 24 provided with the at least one of the louver, the through hole and the protrusion, and the turnup 24 having the corrugated structure may effectively destroy a boundary layer of an airflow and improve the heat exchange efficiency by a turbulent flow.

For example, an opening 25 is defined in the turnup 24, and a heat conducting plate 26 inclined with respect to the opening 25 is arranged at the opening 25. The heat conducting plate 26 has a function of heat conduction. When the airflow outside the tube body flows through the opening 25, the airflow exchanges heat with the heat conducting plate 26, thus further increasing the contact area between the turnup 24 and the airflow outside the tube body, and effectively improving the heat exchange efficiency. Moreover, the heat conducting plate 26 also has a function of guiding the flow, so as to lengthen a flow path and prolong a heat exchange time of the airflow outside the tube body.

Furthermore, a plurality of openings 25 may be defined in the turnup 24, and the heat conducting plates 26 arranged at at least two openings 25 have different orientations.

In some embodiments, the heat conducting plates 26 at the plurality of openings 25 are arranged symmetrically.

In some embodiment, as illustrated in FIGS. 1-14, the inner fin 3 has a plurality of wave crests 301 and a plurality of wave troughs 302, and the wave crests 301 and the wave troughs 302 are alternately arranged to separate a plurality of flow channels 101 in the tube wall 1.

In the present disclosure, the technology of bending the flat tube may be used to effectively realize the lightweight of the heat exchange tube 100. Compared with the extruded flat tube, the forming speed and the yield are greatly improved, which is suitable for a mass scale on-site production, and the logistics and procurement cycles may be greatly shortened. Moreover, the alloy combination solution of the material of the flat tube is flexible. For example, the multi-layer alloy may be applied, which greatly improves the corrosion resistance.

The present disclosure proposes an integral design of a multi-hole tube body and the outer fin 2, the outer fin 2 is processed together with at least one of the inner fin 3 and the tube wall 1, and may be folded from one plate directly.

A thickness of a part of the plate folded to form the outer fin 2 may be smaller than a thickness of another part of the plate folded to form the tube wall 1. On the premise of ensuring the strength of the outer fin 2, the weight of the outer fin 2 is reduced, such that the material is saved and the cost is decreased.

In the present disclosure, the outer fin 2 is processed together with the at least one of the inner fin 3 and the tube wall 1 by a piece of aluminum foil, which provides a high bonding strength and a great heat exchange effect. Further, the assembling process of the heat exchanger is simple.

In addition, the aluminum foil of a part of an outer wall surface of the tube body is folded into 90°, and the folded aluminum foil is provided with the louver to form the outer fin 2. The aluminum foil of the outer fin 2 may also be processed into a needle fin, which has a simple structure and a high heat exchange coefficient.

In addition, the heat exchange tube 100 processed according to the present disclosure enables the thickness of the outer fin 2 to be less than the thickness of the wall of the folded flat tube 1, which reduces the product cost on the premise of ensuring the strength.

While folding and processing of the heat exchange tube 100, the fin of the heat exchanger is processed, i.e. the outer fin 2 of the heat exchange tube 100 is processed, so as to form an integrated assembly, which facilitates to realize an automatic processing of the heat exchanger, improves the fit relationship between the flat tube and the fin, reduces the heat resistance and improves the heat exchange efficiency.

According to another object of the present disclosure, the heat exchanger includes a header and a plurality of heat exchange tubes 100. The heat exchange tube 100 is the heat exchange tube 100 described above, two ends of the heat exchange tube 100 are inserted into the header, and the plurality of heat exchange tubes 100 are stacked.

The heat exchanger according to the embodiments of the present disclosure may effectively improve the fluid heat exchange between internal and external spaces of the heat exchanger and effectively improve the heat exchange efficiency by using the structure of the heat exchange tube 100 described above.

The outer fin 2 may be formed on one surface of the tube body. When the heat exchanger is assembled, the outer fin 2 is welded with the other surface of the adjacent tube body. Of course, the outer fin 2 may be formed on both surfaces of the tube body, and an ordinary flat tube without the outer fin 2 may be welded between the two heat exchange tubes 100.

In a manufacturing method of a heat exchange tube 100 according to yet another object of the present disclosure, the heat exchange tube 100 is the heat exchange tube 100 described above. The manufacturing method includes: processing a first plate portion into the inner fin 3, a second plate portion surrounding the inner fin 3 by at least one circle to be processed into the tube wall 1, and processing a third plate portion into the outer fin 2 outside the tube wall 1. The third plate portion and at least one of the first plate portion and the second plate portion are adjacent parts of the same plate body.

The first plate portion and the third plate portion are processed to form the inner fin 3 and the outer fin 2 by means of bending, extrusion, punching, flanging or the like. After the inner fin 3 and the outer fin 2 are processed, the second plate portion is processed into a structure of the tube wall 1 of the folded flat tube. While the tube wall 1 is processed, the tube wall 1 is mounted and fitted with the inner fin 3 and the outer fin 2 by means of covering and clamping, and is completely fixed with the inner fin 3 and the outer fin 2 by means of welding.

According to the manufacturing method for the heat exchange tube 100 according to the embodiments of the present disclosure, the outer fin 2 and at least one of the tube wall 1 and the inner fin 3 are folded from the same plate, such that the heat of the fluid in the tube wall 1 may be quickly transferred to the outer fin 2, so as to realize the rapid heat exchange between the fluid inside and the fluid outside the tube wall 1, thus effectively improving the heat exchange efficiency of the fluid inside and the fluid outside the tube wall 1. Moreover, the production process may also be simplified. The tube wall 1 and the outer fin 2 may be made from the same plate, or the inner fin 3 and the outer fin 2 may be made from the same plate, or the tube wall 1, the inner fin 3 and the outer fin 2 may be made from the same plate.

In addition, the order of processing and forming the inner fin 3, the outer fin 2 and the tube wall 1 is not limited herein. The tube wall 1 surrounding the inner fin 3 means that tube wall 1 surrounds the inner fin 3 after manufacturing, which does not mean that the tube wall 1 is formed by surrounding the inner fin 3. Instead, the inner fin may be placed in the tube wall 1 after the inner fin and the tube wall 1 are formed respectively.

Of course, the order of processing the inner fin 3, the outer fin 2 and the tube wall 1 may also be limited. According to practical needs, the processing may be performed in a following order, for example, the inner fin 3, the outer fin 2 and the tube wall 1, or the inner fin 3, the tube wall 1 and the outer fin 2, or the outer fin 2, the inner fin 3 and the tube wall 1, or the outer fin 2, the tube wall 1 and the inner fin 3, or the tube wall 1, the outer fin 2 and the inner fin 3, or the tube wall 1, inner fin 3 and outer fin 2.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples. In addition, those skilled in the related art may combine and incorporate different embodiments or examples and their features described in the specification, without mutual contradictions.

Although explanatory embodiments have been illustrated and described, it would be appreciated by those skilled in the art that the above embodiments cannot be construed to limit the present disclosure, and changes, alternatives, and modifications may be made in the embodiments without departing from spirit, principles and scope of the present disclosure.

What is claimed is:

1. A heat exchange tube, comprising:

a tube wall, the tube wall being folded into a tube body, the tube body being provided with an inner fin therein, the inner fin dividing an inner chamber of the tube body into a plurality of flow channels; and an outer fin arranged outside the tube body, wherein the outer fin, the tube wall, and the inner fin are folded from the same plate, wherein the outer fin has a wavy structure extending along a circumferential direction of the heat exchange tube, the outer fin comprises a plurality of fin units extending along an axial direction of the heat exchange tube and spaced apart along the circumferential direction of the heat exchange tube, and a connecting portion connected with adjacent fin units, each of the plurality of fin units and the connecting portion are connected in sequence, such that the connecting portion serves as a wave crest or a wave trough, the outer fin is further provided with an air channel, and the air channel runs through each of the plurality of fin units, wherein two ends of each of the plurality of fin units in a direction perpendicular to the axial direction and the circumferential direction of the heat exchange tube are connected with the connecting portion, respectively, and the two connecting portions connected to the same fin unit extend away from each other along a direction perpendicular to the same fin unit, and wherein the tube wall has a ring structure, the ring structure comprises a first part and a second part spaced apart from each other, the inner fin is arranged between the first part and the second part, and the outer fin stretches from the first part of the ring structure and extends in a wavy configuration at an outer side of the ring structure and directly on the second part of the ring structure.

2. The heat exchange tube according to claim 1, wherein each of the plurality of fin units is provided with a through hole, the through hole is configured as the air channel, and a flow guide portion is provided at an edge of the through hole.

3. A heat exchanger, comprising:

a header; and a plurality of heat exchange tubes according to claim 1, two ends of the heat exchange tube being inserted into the header, and the plurality of heat exchange tubes being stacked.

4. A manufacturing method for a heat exchange tube according to claim 1, comprising:

processing a first plate portion into the inner fin;

a second plate portion surrounding the inner fin by at least one circle to be the tube wall; and processing a third plate portion into the outer fin outside the tube wall, wherein the first plate portion, the second plate portion and the third plate portion are adjacent parts in sequence of a same plate body.

5. A manufacturing method for a heat exchange tube, the heat exchange tube comprising:

a tube wall, the tube wall being folded into a tube body, the tube body being provided with an inner fin therein, the inner fin dividing an inner chamber of the tube body into a plurality of flow channels; and an outer fin arranged outside the tube body, wherein the outer fin, the tube wall and the inner fin are folded from the same plate, and the same plate comprises a first plate portion, a second plate portion and a third plate portion adjacent in sequence, wherein the second plate portion has a first end connected with the third plate portion and a second end connected with the first plate portion, wherein the outer fin has a wavy structure extending along a circumferential direction of the heat exchange tube, the outer fin comprises a plurality of fin units extending along an axial direction of the heat exchange tube and spaced apart along the circumferential direction of the heat exchange tube, and a connecting portion connected with adjacent fin units, each of the plurality of fin units and the connecting portion are connected in sequence, such that the connecting portion serves as a wave crest or a wave trough, the outer fin is further provided with an air channel, and the air channel runs through each of the plurality of fin units, two ends of each of the plurality of fin units in a direction perpendicular to the axial direction and the circumferential direction of the heat exchange tube are connected with the connecting portion, respectively, and the two connecting portions connected to the same fin unit extend away from each other along a direction perpendicular to the same fin unit, wherein the tube wall has a ring structure, the ring structure comprises a first part and a second part spaced apart from each other, the inner fin is arranged between the first part and the second part, and the outer fin stretches from the first part of the ring structure, and extends in a wavy configuration at an outer side of the ring structure and directly on the second part of the ring structure, wherein the manufacturing method comprises:

processing the first plate portion into the inner fin;

bending the first end of the second plate portion to the second end of the second plate portion to surround the inner fin to form the ring structure of the tube wall; and stretching the third plate portion outwards from the first end of the bent second plate portion and extending the third plate portion in a wavy configuration at an outer side of the ring structure and directly on the second part of the ring structure to form the outer fin.

* * * * *